US006682356B2

(12) United States Patent
Erez et al.

(10) Patent No.: US 6,682,356 B2
(45) Date of Patent: Jan. 27, 2004

(54) PERIPHERAL DEVICE PORT FOR MOTOR VEHICLES

(75) Inventors: Jacob Erez, San Diego, CA (US); Brian K. Tucker, Poway, CA (US)

(73) Assignee: Wingcast, LLC, San Diego, CA (US)

( * ) Notice: Subject to any disclaimer, the term of this patent is extended or adjusted under 35 U.S.C. 154(b) by 0 days.

(21) Appl. No.: 10/099,644

(22) Filed: Mar. 14, 2002

(65) Prior Publication Data

US 2003/0176087 A1 Sep. 18, 2003

(51) Int. Cl.[7] ..... H01R 13/648

(52) U.S. Cl. ..... 439/108; 439/34; 439/668; 439/135

(58) Field of Search ..... 439/108, 34, 35, 439/92, 607, 608, 609, 610, 668, 866, 939, 135, 136, 137, 138, 142, 296, 297, 299, 310

(56) References Cited

U.S. PATENT DOCUMENTS

| | | | | | |
|---|---|---|---|---|---|
| 5,263,879 | A | * | 11/1993 | Sasa et al. | 439/668 |
| 5,649,840 | A | * | 7/1997 | Muto | 439/668 |
| 5,775,952 | A | * | 7/1998 | Lu | 439/668 |
| 6,116,960 | A | * | 9/2000 | Lloyd et al. | 439/668 |
| 6,222,987 | B1 | * | 4/2001 | Duke et al. | 392/383 |
| 6,296,526 | B1 | * | 10/2001 | Hussaini et al. | 439/668 |

FOREIGN PATENT DOCUMENTS

| | | | | |
|---|---|---|---|---|
| EP | 0 310 718 | A1 | * 12/1989 | H01R/13/64 |

* cited by examiner

*Primary Examiner*—P. Austin Bradley
*Assistant Examiner*—Edwin A. Léon
(74) *Attorney, Agent, or Firm*—Black Lowe & Graham, PLLC

(57) ABSTRACT

The invention provides a device port and associated connector which may be easily implemented by automobile manufacturers with minimal redesign and retooling by utilizing existing cigarette lighter and power port configurations to create the device port of the invention.

14 Claims, 8 Drawing Sheets

B-B

A-A

PERIPHERAL DEVICE PORT FOR MOTOR VEHICLES

BACKGROUND OF THE INVENTION

1. Field of the Invention

The present invention relates to device interfaces and ports (collectively referred to herein as "ports") for peripheral devices that may be used within automobiles, or other vehicles, and, more particularly, to a peripheral device port that is configured to be integrated with a cigarette lighter port or power port typically found in motor vehicles today.

2. Description of Related Art

A common dilemma within the automotive manufacturing industry today is the ability to react quickly to changes in consumer preferences and deal with multiple consumer devices that may be made by various manufacturers. In the past, automotive manufacturing companies (OEM's) have typically taken between two and four years, from conception to product launch, to integrate a consumer-desired feature into a vehicle. Typically, the process of integrating a new feature within a vehicle requires custom packaging, hardening of the electronics for durability and longevity, and rigorous testing to ensure that customers' expectations of quality and functionality for OEM installed equipment are met. Because of this delay in the OEM manufacturing process, it is often difficult for OEM's to keep apace with the rapid advancements in technology that become available in the interim period. Consequently, it is often the case that a "factory installed" device, which has been integrated into the vehicle by the OEM manufacturer, is or becomes outdated technology shortly after the automobile is placed into the marketplace.

Aftermarket electronic manufacturers do not suffer from the same constraints as the OEM and as such, tend to have a lower expectation from consumers in terms of quality, longevity and price. For example, a consumer may be willing to put up with less functional integration with the vehicle in return for the latest technology. These consumers are generally referred to as "early adopters." Additionally, consumer electronic products typically have a significantly shorter product life than the vehicle in which it may be installed. By the time an automotive manufacturer can integrate a product into its vehicles and bring the product to market, the product may be out of date and/or may no longer be supported by its original manufacturer or support infrastructure.

Automotive manufacturers, to date, have failed in their attempts to integrate consumer grade electronics into their vehicles and keep pace with the latest advancements in technology. Aftermarket products such as hands-free car kits for cellular phones have had some limited success but are either poorly integrated into the vehicle, limiting their functionality, or too obtrusive and invasive to be accepted by large numbers of consumers. Many attempts have been made to form a cooperative standard between the aftermarket community and the OEMs. To date, no product has been brought to market that shares a standardized interface recognized by both the OEMs and the aftermarket vendors. For example, a limited number of OEMs have marketed hands-free cellular phone options but not in a form that aftermarket suppliers can design too. Additionally, aftermarket hands-free kits are unique to either a particular cellular phone brand or a particular supplier's standards.

For example, U.S. Pat. No. 6,212,415 B1 to Demuro et al. discloses a power adapter configured to be plugged into a cigarette lighter or other power source of a vehicle, having a first connector configured to be coupled to an external antenna and a second connector configured to be coupled to a communication device (e.g., a cellular telephone). The Demuro power adapter device plugs into a traditional cigarette lighter port and utilizes traditional power and ground connections within the cigarette lighter port to provide transformed power to the communication device. The external antenna port is not integrated into the cigarette lighter port but is provided on the adapter itself, requiring that a second wire or connection be made by the user to connect his or her communication device to an external antenna. This approach is not only clumsy and cumbersome for a user desiring to use a cellular phone within his or her vehicle but requires that multiple wires be connected and exposed in the passenger cabin of the vehicle. Consequently, this approach has proven too obtrusive and invasive to receive wide acceptance among consumers who desire to use communication devices in their automobiles.

Other approaches to providing peripheral device ports within vehicles have been difficult to implement for OEMs, requiring significant retooling, redesign and added costs to the manufacturing process. For example, U.S. Pat. No. 6,163,079 to Miyazaki et al. discloses providing multiple side-connectors within the cabin of the vehicle to connect to a variety of peripheral devices. These side-connectors do not take advantage of the existing port space provided by standard cigarette lighters or power ports already existing within vehicles today, and, therefore, require substantial retooling and redesign of the interior cabin and panels of vehicles. Additionally, because of the relatively complex nature of the interface design, the system of Miyazaki et al. provides limited flexibility and compatibility of operation with peripheral devices manufactured by third party vendors.

In view of the foregoing, there exists a need for a method and device that will allow automobiles to easily interface with the latest consumer grade aftermarket electronic devices, requiring minimal retooling, redesign and added costs to the OEM manufacturing process. There exists a need for a method and device to easily and unobtrusively integrate aftermarket products into vehicles and provide an elegant interface that is easily adoptable by both OEMs and aftermarket vendors. There also exists a need for a method and device that will allow consumers to easily connect aftermarket devices to available electrical signals within the vehicle without requiring a cumbersome connection process and unnecessary wires which clutter the cabin of the vehicle. As used herein, the terms "aftermarket product" or "aftermarket device" refer to products and devices that are not integrated into the vehicle by the OEM manufacturer. The terms "aftermarket vendor," "aftermarket supplier," or "aftermarket manufacturer" refer to manufacturers of aftermarket products and devices and may be third party manufacturers or the OEMs themselves.

SUMMARY OF THE INVENTION

The invention addresses the above and other needs by providing a peripheral device port and associated connector which allow aftermarket peripheral devices to easily and unobtrusively interface with the electrical systems and signals that are available within an automobile. The device port is integrated with an existing cigarette lighter or power port of an automobile. In one preferred embodiment, in addition to providing the traditional functions of a cigarette lighter and power supply, this port may provide vehicle interface signals such as ignition sensor signals, radio mute, audio in, airbag sensor, odometer pulse, fuel level, cellular antenna, GPS antenna, or any other signals that may be available within the automobile, so as to provide a peripheral device port capable of interfacing with one or more aftermarket products that utilize one or more of the vehicle interface signals mentioned above. Aftermarket devices utilizing the access port of the present invention may be as varied as hands-free kits for wireless telephones, GPS navigation devices, onboard computing devices, wireless internet devices, radios, CD players, etc., as well as future aftermarket devices which have heretofore not been developed. In a preferred embodiment, the traditional functions of the cigarette lighter and the power port with current aftermarket products, such as cellular phone chargers, for example, will remain unaffected.

As consumer electronic devices change or new devices emerge, only the associated port needs to be modified by the OEM to accommodate the new or changed application. This frees the OEM from trying to anticipate the necessary interfaces, packaging and retention methods normally associated with regular production options. By utilizing the existing location of the cigarette lighter or power port of a vehicle, OEMs are now capable of immediately offering the interface capability without waiting for a vehicle update cycle to change the instrument panel or console tooling in order to accommodate package space and retention mechanisms.

Thus, one of the advantages provided by the present invention is that it allows the OEM to easily provide access to critical vehicle interface signals necessary for third party products without substantially affecting either the OEM tooling for customer visible surfaces such as an instrument panel. Additionally, the present invention eliminates the need for aftermarket installers to splice into existing vehicle wiring or cut into the instrument panel or dashboard to "install" aftermarket products. Additionally, any required changes to accommodate new or changed product specifications that occur during the OEM manufacturing cycle may be easily addressed by the OEM without significant retooling or redesign of the manufacturing process.

DETAILED DESCRIPTION OF THE PREFERRED EMBODIMENTS

The invention, in accordance with various preferred embodiments, is described in detail below with reference to the figures, wherein like elements are referenced with like numerals throughout.

Figure 1:
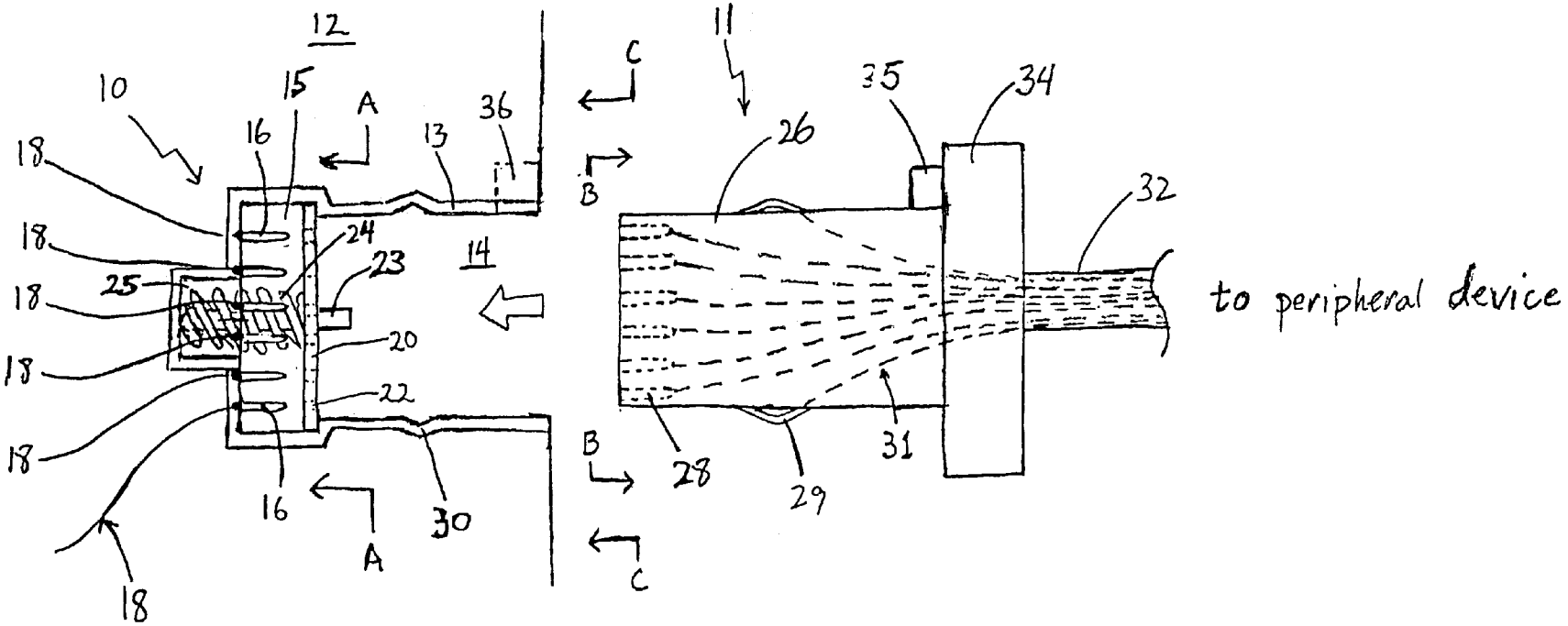
FIG. 1 illustrates a cross-sectional side view of a peripheral device port and associated connector in accordance with one embodiment of the invention.

FIG. 1 illustrates a cross-sectional side view of a peripheral device port 10 and associated device connector 11 configured to be received within the port 10, in accordance with one embodiment of the invention. As shown in FIG. 1, the device port 10 is located or embedded within a dashboard or instrument panel 12 of a motor vehicle such that it is configured to be integrated with an existing cigarette lighter port or power port (collectively referred to herein as a "power port"), found in most vehicles today. The device port 10 includes at least one side wall 13 forming an interior chamber 14, typically cylindrical in shape, for receiving therein a typical cigarette lighter element (not shown) or a power adapter connector (not shown) such as those used for powering cellular telephones, for example. The port 10 includes a second interior chamber 15 adjacent the first interior chamber 14. A plurality of connector pins 16 protrude outwardly from the base wall of the second interior chamber 15.

The connector pins 16 are connected via wires or other known conductors 18 to the various electrical signals that may be available from or within an automobile such as global positioning satellite (GPS) signals, airbag status signals, external antenna signals, etc. (e.g., any signals available within the automobile). The wires 18 are routed, as necessary, through the chassis of the automobile so that their end points are connected to respective pins 16 as shown in FIG. 1. In a preferred embodiment, each pin 16 is positioned at a specified location and orientation within the chamber 14 and designated to be connected to a specified type of signal. In this way, the signals provided by each pin 16 within the device port 10 may become standardized and known. As would be apparent to one of ordinary skill in the art, each pin 16 is electrically insulated from one another. This may be accomplished by forming at least the base wall of the interior chamber 15 from an electrically insulating material. Other methods of insulating each of the pins 16 are known in the art and would be readily apparent to those of ordinary skill in the art.

In accordance with one preferred embodiment, the device port 10 further includes an insulating cover 20 positioned within the second interior chamber 15. The cover 20 has pin holes 22 therein for allowing the connector pins 16 to protrude therethrough and a center hole (not shown) for allowing a power pin 23 to protrude therethrough. The power pin 23 is positioned and configured substantially similarly to power pins found in traditional cigarette lighter ports and is typically connected to an automobile's battery or other power source. In a preferred embodiment, the power pin 23 extends through the center axis of a spring element 24 that spring loads the cover 20. As shown in FIG. 1, spring element 24 is seated within a third chamber 25 adjacent the second chamber 15. The third chamber 25 provides the space necessary to hold the spring element 24 when it is in a compressed state, allowing the cover 20 to substantially move toward the base wall of the second chamber 15 when the spring element 24 is compressed. In a preferred embodiment, the circumference of the second interior chamber 15 is greater than that of the first interior chamber 14 so as to allow the movement of the insulating cover 20 within the second chamber 15 as it is pushed toward and away from the base or bottom wall of the second chamber 15. The circumference of the first interior chamber 14 is smaller than the circumference of the insulating cover 20 such that it limits the movement of the insulating cover 20 away from the base wall of the second chamber 15 by the force of the spring element 24.

The cover 20 serves to protect the underlying pins 16 from debris, dust, ashes and heat that may be generated from a cigarette lighter element (not shown) when it is received and heated within the device port 10. The length of the chamber 14 is such that the cover 20 will not be pushed back toward the base of the second chamber 15, exposing the pins 16 through the pin holes 22, when a traditional cigarette lighter element is inserted into the port 10 for heating. However, in one preferred embodiment, when the peripheral device connector 11 is fully inserted into the port 10, a cylindrical prong 26 of the connector 11 passes through the first interior chamber 14 and pushes the protective cover 20 back toward the base of the second chamber 15, compressing the spring element 24. As the cover 20 is pushed back toward the base, the connector pins 16 protrude through the pin holes 22 to be received within and electrically coupled to corresponding pin sockets 28 located at the base of the cylindrical prong 26.

In a preferred embodiment, at least a portion of the interior side wall 13 of the chamber 14 provide a conductive contact to electrical ground, typically connected to a metal chassis of the automobile. When the cylinder prong 26 is inserted into the chamber 14, slide contacts 29 located on the external side wall of the cylindrical prong 26 make contact with corresponding portions of the side wall 13 of the interior chamber 14 and provide an electrical contact to ground for aftermarket devices connected to the connector 11. In one embodiment, at least one indentation or groove contact 30 is formed or embedded in the side wall 13 to function as a conductive contact to ground. The slide contacts 29 "snap" into corresponding indentation or groove contacts 30 within the side wall 13 so as to secure the connector 11 within the device port 10 against the opposing force of the spring element 24. Other and/or additional methods of securing the connector 11 within the device port 10 are known in the art and would be readily apparent to those of ordinary skill in the art.

When engaged with the connector pins 16, the pin sockets 28 conduct (i.e., transfer) one or more desired signals received from the corresponding one or more connector pins 16 to a peripheral device (not shown) via corresponding wires 31 connected to the sockets 28 and located within the housing of the connector 11. The wires 31 are then routed to the peripheral device via a cable 32. The travel of the cylindrical prong 26 into the chamber 14 is limited by a flanged end 34 of the connector 11 and further guided by a notch 35 which protrudes outwardly from an underside of the lip of the flanged end 34 and configured to be received by a guide groove 36 correspondingly located within the dashboard or instrument panel 12, as illustrated in FIG. 1. The flanged end 34 ensures that the cylindrical prong 26 is inserted into the chamber 14 of the port 10 a proper distance. The notch 35 and groove 36 function to align the connector 11 with the port 10 such that the connector pins 16 are properly received within the pin sockets 28. Other methods of aligning the connector 11 with the port 10 are contemplated by this invention and known in the art.

Figure 2:
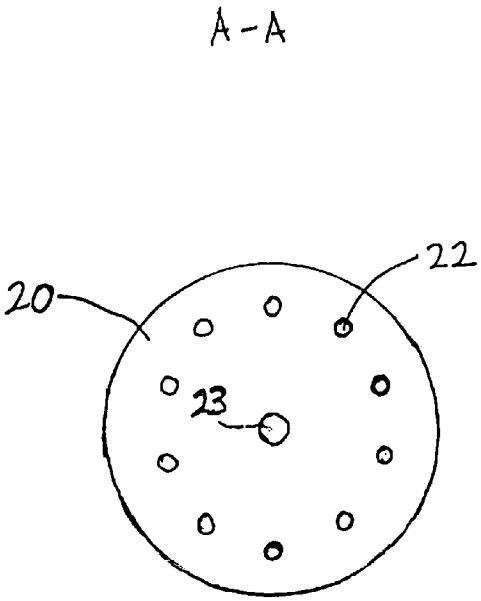
FIG. 2 illustrates a top view of a protective cover located within a chamber of the device port of FIG. 1, taken along a perspective indicated by lines A—A of FIG. 1, in accordance with one embodiment of the invention.

Referring to FIG. 2, a cross-sectional top view of the insulating cover 20 of the device port 10, taken from a perspective along lines A—A of FIG. 1, is illustrated in accordance with one embodiment of the invention. The insulating cover 20 is circular in shape and includes a plurality of pin holes 22 for allowing the connector pins 16 (FIG. 1) to pass through the insulating cover 20 when it is pushed toward the base of the second interior chamber 15 (FIG. 1) of the device port 10. The pin holes 22 are dispersed in a circular fashion surrounding the center of the insulating cover 20 such that their locations match corresponding connector pins 16. As shown in FIG. 2, the power pin 23 protrudes outwardly from a center hole of the insulating cover 20.

It is understood that the configuration of the pin holes 22 and the underlying pins 16 are exemplary only and that other configurations are contemplated such that the size and shape of the pins 16 and corresponding pin holes 22 and their locations, geometry and orientation may be altered, as desired, by those of ordinary skill in the art, without undue experimentation. For example, some pins 16 may be square, rectangular, curved blade, etc. in shape and the corresponding holes 22 would match those shapes, sizes and locations. Additionally, for example, the location of the pins 16 and the pin holes 22 may be such that they are dispersed in a square, triangular, or other geometrical pattern around the center power pin 23.

Figure 3:
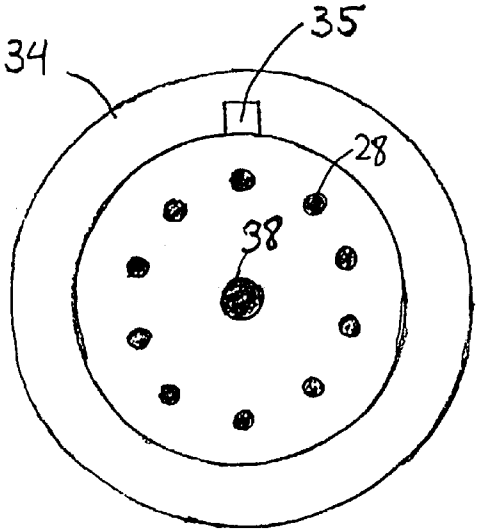
FIG. 3 illustrates a bottom view of the connector configured to be received by the port of FIG. 1, taken along a perspective indicated by lines B—B of FIG. 1, in accordance with one embodiment of the invention.
Figure 4:
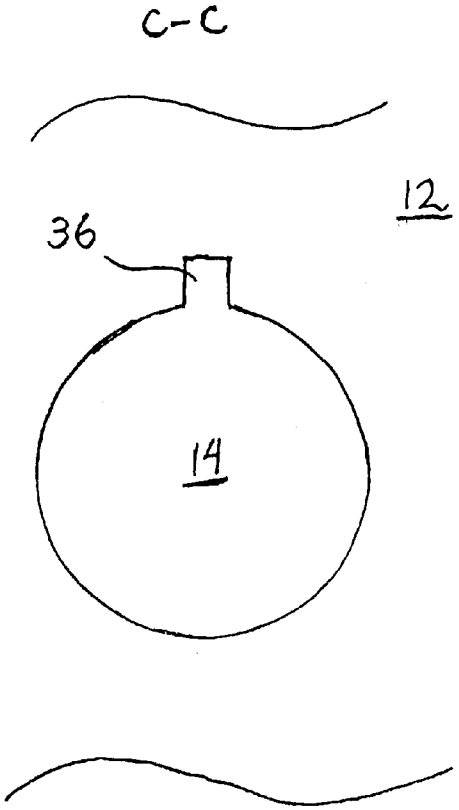
FIG. 4 illustrates a front view of the opening of the device port of FIG. 1, taken along a perspective indicated by lines C—C of FIG. 1, in accordance with one embodiment of the invention.

FIG. 3 illustrates a bottom view of the connector 11 of FIG. 1 taken from a perspective along lines B—B of that figure. As may be discerned by interposing FIGS. 2 and 3, the connector 11 includes a cylindrical prong 26 which is configured to pass through the first interior chamber 14 of the device port 10. The connector 11 further includes a plurality of pin sockets 28 located on a bottom surface of the cylindrical prong 26 and dispersed in a circular fashion around a center socket 38 for receiving the power pin 23 (FIGS. 1 and 2). The pin sockets 28 and center socket 38 are sized and positioned to receive corresponding pins 16 and power pin 23, respectively, within the device port 10. As discussed above, the size, shape and location of the pin sockets 28 and center socket 38 may be changed to match any desired size, shape and location of the pins 16, pin holes 22 and power pin 23 of the device port 10. The connector 11 further includes a cylindrically shaped flanged end 34 having a circumference greater than the circumference of the cylindrical prong 26. Protruding outwardly from an underlying surface of the lip of the flanged end 34 is a guide notch 34 which is configured to be received within a guide groove 36 as shown in FIG. 4. The flanged end 34, the guide notch 35 and guide groove 36 cooperate to ensure that the cylindrical prong 26 of the connector 11 is aligned and fully inserted into the device port 10.

FIG. 4 shows a front view of the opening of the device port 10, taken from a perspective along lines C—C of FIG. 1. As illustrated by FIG. 4, in one preferred embodiment, the guide groove 36 for receiving the guide notch 35 is located in a corresponding top peripheral location of the circular opening to interior chamber 14. It is readily apparent to one of ordinary skill in the art that the size, shape and locations of the guide notch 35 and guide groove 36 may be modified without departing the from spirit and scope of the present invention.

Figure 5:
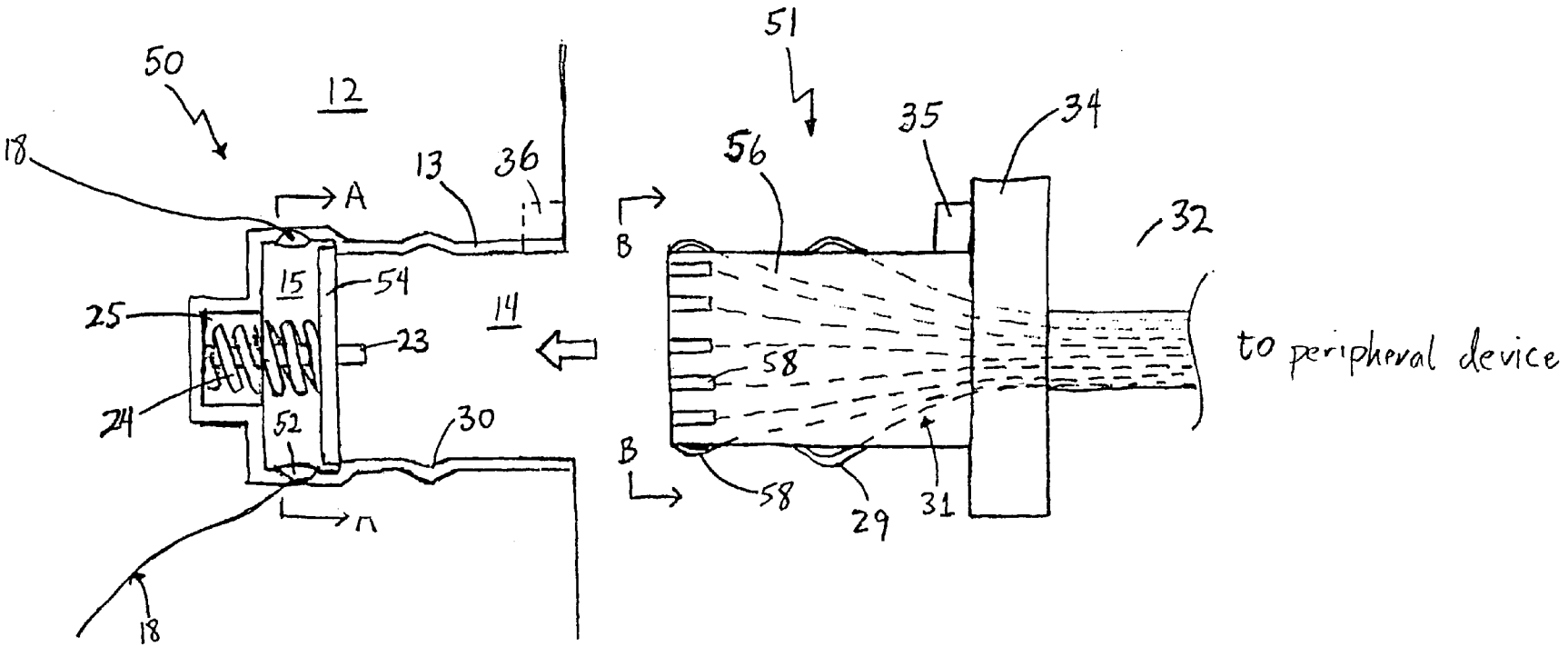
FIG. 5 illustrates a cross-sectional side view of a peripheral device port and associated connector in accordance with another embodiment of the invention.

FIG. 5 illustrates a device port 50 and associated connector 51 in accordance with another embodiment of the present invention. As shown in FIG. 5, device port 50 is similar to the device port 10 of FIG. 1 except that the connector pins 16 and pin sockets 28 of device port 10 are replaced by slide contacts 52 and 58, respectively. Additionally, insulating cover 20 is replaced by an insulating cover 54 which does not have any pin holes 22. The slide contacts 52 are dispersed along the interior side wall of the second interior chamber 15 adjacent the first interior chamber 14. As described above with respect to FIG. 1, the circumference of the second interior chamber 15 is greater than that of the first interior chamber 14 so as to allow the movement of the insulating cover 54 within the second chamber 15 as it is pushed toward and away from the base wall of the second chamber 15. The circumference of the first interior chamber 14 is smaller than the circumference of the insulating cover 54 such that it limits the movement of the insulating cover 54 away from the base wall of the second interior chamber 15 by the opposing force of the spring element 24.

Similar to the function of the insulating cover 20 of FIG. 1, the insulating cover 54 serves to protect the slide contacts 52 from dust, debris, ashes and heat that may result from the use of a cigarette lighter element in the port 50. The cover 54 is spring loaded by a spring element 24 which is seated within the third chamber 25 in similar fashion to that described above with respect to FIG. 1. A power pin 23 extends through a central axis of the spring element 24 and protrudes through a center hole of the insulating cover 54.

When the connector 51 is inserted into the device port 50, a cylindrical prong 56 of the connector 51 passes through the first interior chamber 14 of the port 10 and pushes the insulating cover 54 toward the rear wall of the second interior chamber 15, compressing the spring element 24 into the spring chamber 25. As shown in FIG. 5, the slide contacts 52 within the device port 50 are located and dispersed around the internal side wall of the second interior chamber 15 of the port 50. The slide contacts 58 of the connector 51 are located and dispersed around the external side wall of the cylindrical prong 56, near the base or end of the cylindrical prong 56 that first enters the first interior chamber 14. When the connector 51 is fully inserted into the port 50, each of the slide contacts 58 make electrical contact with a corresponding slide contact 52. Each slide contact 52 is connected to receive a specified electrical signal via a conductive wire 18 that is routed, as necessary, through the automobile chassis to provide connectivity to a desired signal source (e.g., GPS antennae). Each slide contact 58 is connected to a corresponding wire or conductor 31 which is then routed through a cable 32 to provide electrical connectivity to a peripheral device.

The connector 51 further includes slide contacts 29 located along the external side wall of the cylindrical prong 56, a flanged end 34 and a guide notch 35, as shown in FIG. 5. These elements and their functions are described and reference above with like numerals in connection with FIG. 1 and, therefore, these descriptions need not be repeated here. Similarly, the side wall indents 30 formed in the side wall 13 of the first interior chamber 14, and the guide groove 36 are described and referenced above with like numerals with respect to FIG. 1. As would be apparent to one of ordinary skill in the art, each of the slide contacts 52 must be electrically insulated from one another and from ground contact or indent 30. In one embodiment, this may be accomplished by forming at least the side wall surrounding the interior chamber 15 from an electrically insulating material which adjoins and is connected to the adjacent side wall surrounding the first interior chamber 14. Other methods of insulating each of the contacts 52 are known in the art and would be readily apparent to those of ordinary skill in the art.

Figure 6:
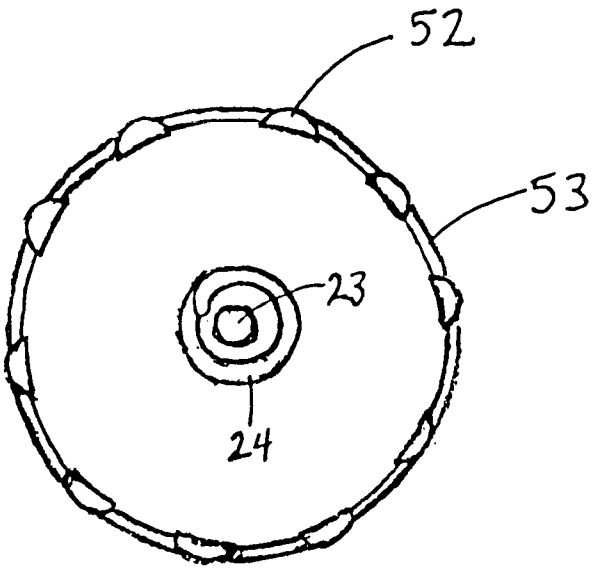
FIG. 6 illustrates a cross-sectional bottom view of the device port of FIG. 5, taken along a perspective indicated by lines A—A of FIG. 5, in accordance with one embodiment of the invention.

FIG. 6 illustrates a cross-sectional view of the second interior chamber 15 of the device port 50, shown from a perspective along lines A—A of FIG. 5. In a preferred embodiment, the slide contacts 52 are embedded and dispersed around the side wall 53 of the second interior chamber 15 such that a contact surface of each slide contact 52 is exposed within the chamber 15 and substantially flush with the interior surface of the side wall 53. As shown in FIG. 6, the slide contacts 52 are arranged in a circular pattern around the power pin 23 and spring element 24 which are located at the center of the circular pattern.

Figure 7:
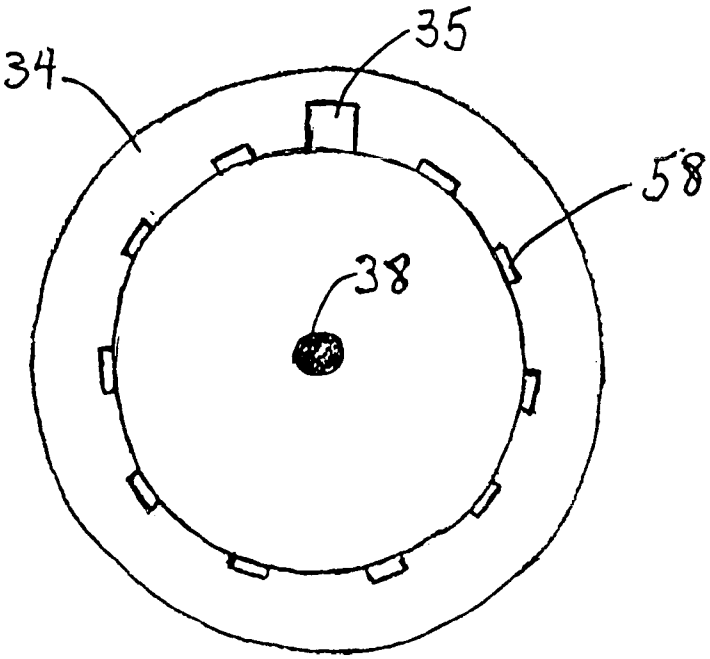
FIG. 7 illustrates a bottom view of the connector of FIG. 1, taken along a perspective indicated by lines B—B of FIG. 5, in accordance with one embodiment of the invention.

FIG. 7 illustrates a bottom view of the connector 51 of FIG. 6, shown from a perspective along lines B—B of FIG. 6. The slide contacts 58 are embedded and located in a circular fashion on the exterior side wall of the cylindrical prong 56, near the base or bottom portion of the cylindrical prong 56. The slide contacts 58 are arranged and spaced such that when the connector 51 is fully inserted into the device port 50, the slide contacts 58 make electrical contact with a corresponding one of slide contacts 52 located in the second chamber 15 of the port 50. Slide contacts 52 and 58 and similar types of contacts are well known in the art. Located at an opposite, top portion of the cylindrical prong 56 is a flanged end 34 having a cylindrical circumference greater than that of the cylindrical prong 56. Extending outwardly from an underside of a lip of the flanged end 34 is a guide notch 35. The flanged end 34 and the guide notch 35 are described and referenced above with like numerals in connection with FIG. 1.

Figure 8:
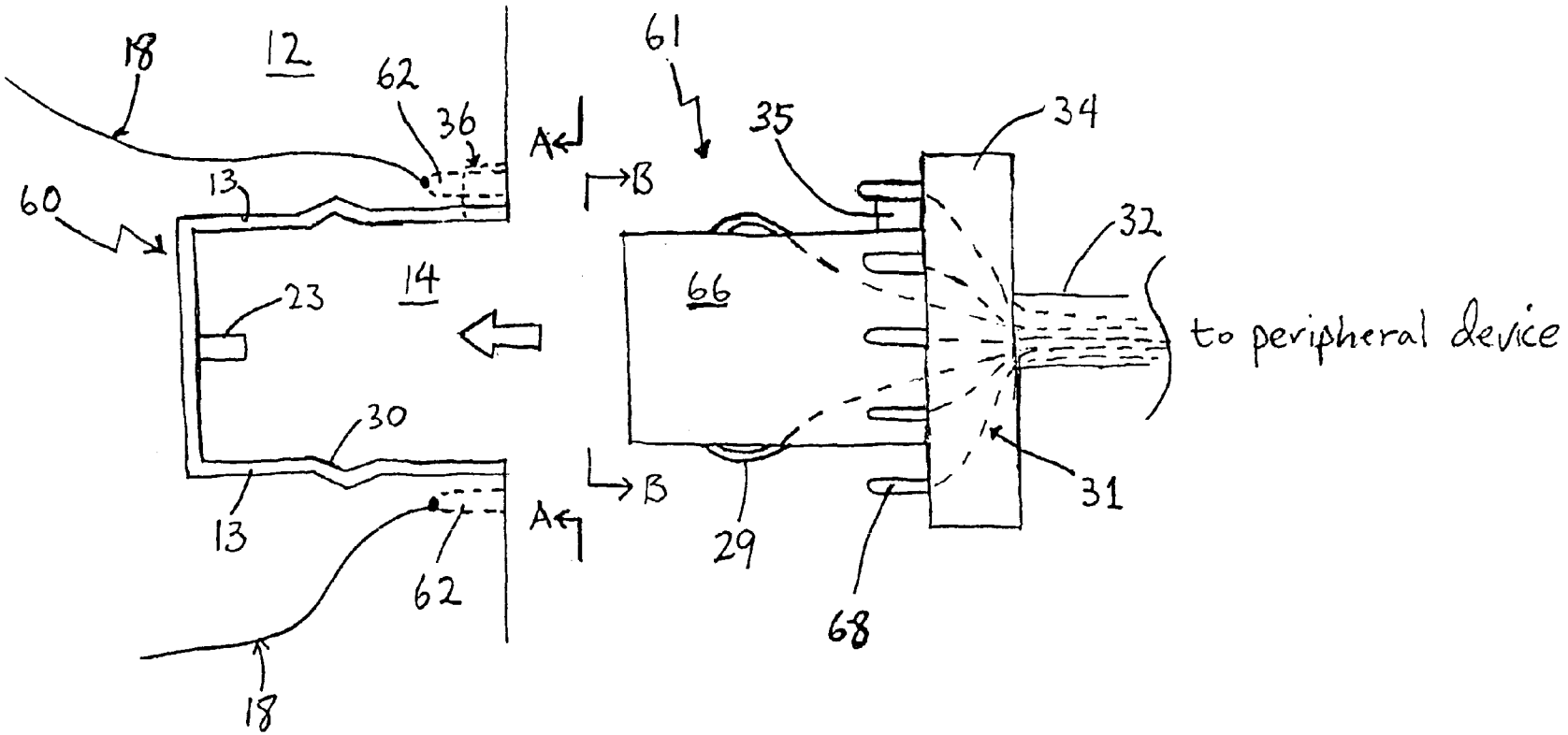
FIG. 8 illustrates a cross-sectional side view of a peripheral device port and associated connector in accordance with another embodiment of the invention.

FIG. 8 illustrates a cross-sectional side view of a device port 60 and associated connector 61 in accordance with a further embodiment of the invention. The device port 60 includes at least one side wall 13 forming a first interior chamber 14. A power pin 23 extends outwardly from the center of a base wall of the interior chamber 14. A plurality of pin sockets 62 are embedded in the dash panel 12 and located around the periphery of the opening of the interior chamber 14. The pin sockets 62 are positioned and configured to receive a corresponding one of a plurality of contact pins 68 that extend outwardly from the underside of the lip of the flanged end 34 of the connector 61 when the connector 61 is fully inserted into the device port 60.

Each pin socket 62 is connected to receive a specified electrical signal via a conductive wire 18 that is routed, as necessary, through the automobile chassis to provide connectivity to a desired signal source (e.g., GPS antenna). Each contact pin 68 is connected to a corresponding wire or conductor 31 that is routed through a cable 32 to provide electrical connectivity to a peripheral device (not shown). As described above, the flanged end 34, guide notch 35 and guide groove 36 function to limit and align the movement of the connector 61 into the port 60. Ground slide contacts 29 located on the exterior side wall of the cylindrical prong 66 and indent contacts 30 located on the interior side wall of chamber 14 function as described above with respect to FIGS. 1 and 5. As would be apparent to one of ordinary skill in the art, each pin socket 62 is electrically insulated from one another. Similarly, each of the contact pins 68 are electrically insulated from each other. Many methods of insulating each of the pin sockets 62 and contact pins 68 are known in the art and would be readily apparent to those of ordinary skill in the art.

Figure 10:
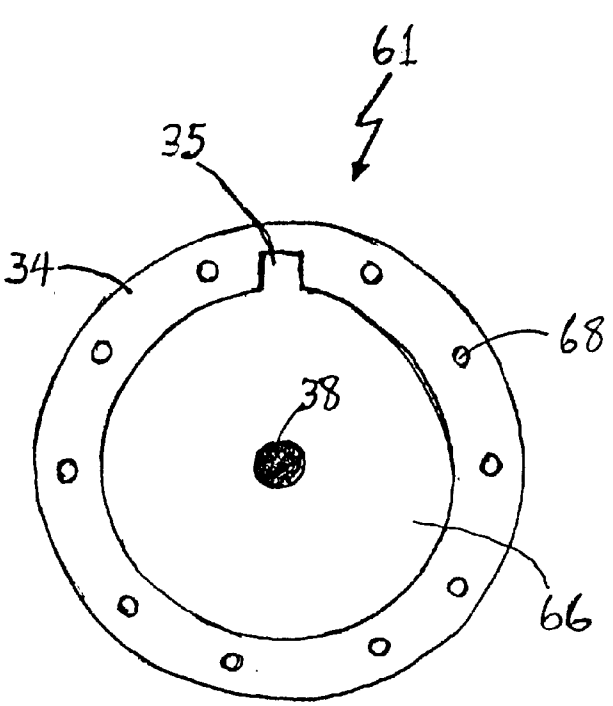
FIG. 10 illustrates a bottom view of the connector of FIG. 8, taken along a perspective indicated by lines B—B of FIG. 8, in accordance with one embodiment of the invention.
Figure 9:
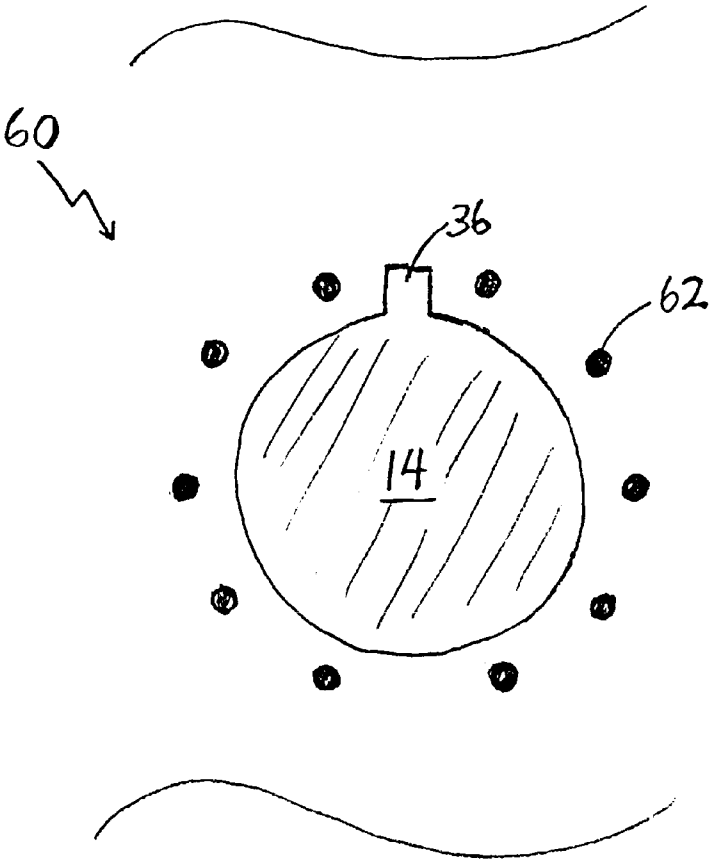
FIG. 9 illustrates a front view of the opening of the device port of FIG. 8, taken along a perspective indicated by lines A—A of FIG. 8, in accordance with one embodiment of the invention.

FIG. 9 illustrates a front view of the opening of the device port 60 of FIG. 8, taken from a perspective indicated by lines A—A of FIG. 8, in accordance with one embodiment of the invention. As shown in FIG. 9, a plurality of pin sockets 62 are embedded in the dash panel 12 surrounding the opening of the interior chamber 14 in a circular pattern. The sockets 62 are positioned and configured to receive corresponding ones of a plurality of contact pins 68 (FIG. 10) which extend outwardly from the underside of the lip of the flanged end 34 of the connector 61, as shown in FIG. 10, when the cylindrical prong 66 is fully inserted into the interior chamber 14 and the guide notch 35 is aligned with the guide groove 36. A power pin socket 38 is located at the center of the base of the cylindrical prong 61 so as to receive the power pin 23 (FIG. 8) when the prong 66 is fully inserted into the chamber 14.

Figure 11:
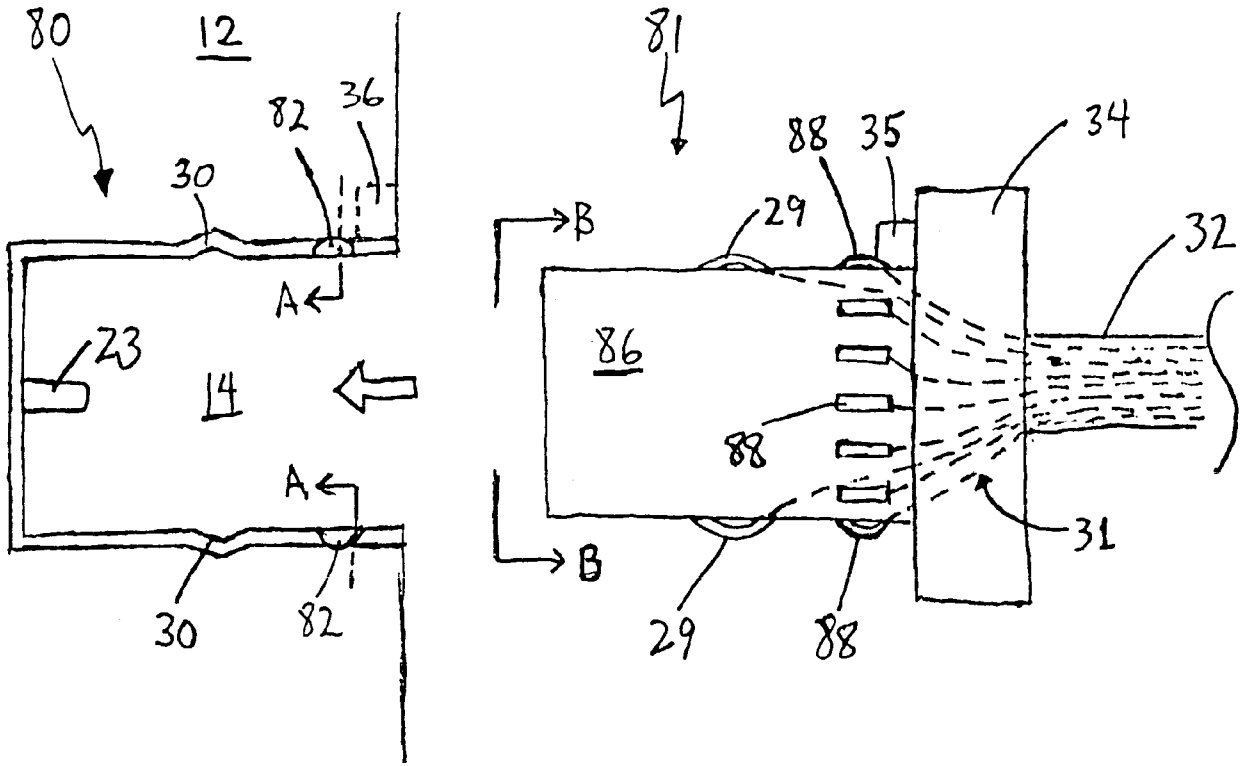
FIG. 11 illustrates a cross-sectional side view of a peripheral device port and associated connector in accordance with a further embodiment of the invention.

FIG. 11 illustrates a cross-sectional view of a device port 80 and associated connector 81 in accordance with another embodiment of the invention. The device port 80 includes at least one side wall 13 which forms an interior chamber 14. A power pin 23 extends outwardly from the center of the base of the interior chamber 14 toward the opening of the chamber 14. Indent contacts 30 are located on the interior side wall 13 and configured to mate with and contact ground contacts 29 in a similar fashion to that described above with respect to FIGS. 1, 5 and 8. In this embodiment, however, slide contacts 82 are embedded in the interior side wall 13 in a circular fashion surrounding the interior chamber 14, near the opening of the chamber 14. These slide contacts 82 are connected to wires or conductors 18 which provide connectivity to specified electrical signals that are available from the automobile (e.g., airbag deployment sensor, GPS antenna, etc.). Each of the plurality of wires 18 are routed, as necessary through the chassis of the car so as to arrive at the location of the device port 80 in the dash panel 12 and connect to specified ones of the plurality of contacts 82.

The connector 81 is similar to the connectors previously described above except the plurality of slide contacts 88 are located on the exterior side wall of the cylindrical prong 86 near the flanged end 34 of the connector 81, as shown in FIG. 11. The slide contacts 88 are distributed in a circular fashion around the cylindrical side wall of the prong 86 such that they are positioned and configured to make electrical contact with the slide contacts 82 of the device port 80 when the cylindrical prong 86 is fully inserted into the interior chamber 14 and aligned by the guide notch 35 and guide groove 36. As would be apparent to one of ordinary skill in the art, each of the slide contacts 82 is electrically insulated from one another. This may be accomplished by forming a ring of insulating material around each contact 82 which prevents the contacts 82 from making electrical contact with the side wall 13 or forming at least a portion of the side wall 13, in which slide contacts 82 are embedded, from an electrically insulating material. Similarly, slide contacts 88 on connector 81 are also electrically insulated from one another. Many methods of insulating each of the slide contacts 82 and 88 are known in the art and would be readily apparent to those of ordinary skill in the art.

Figure 12:
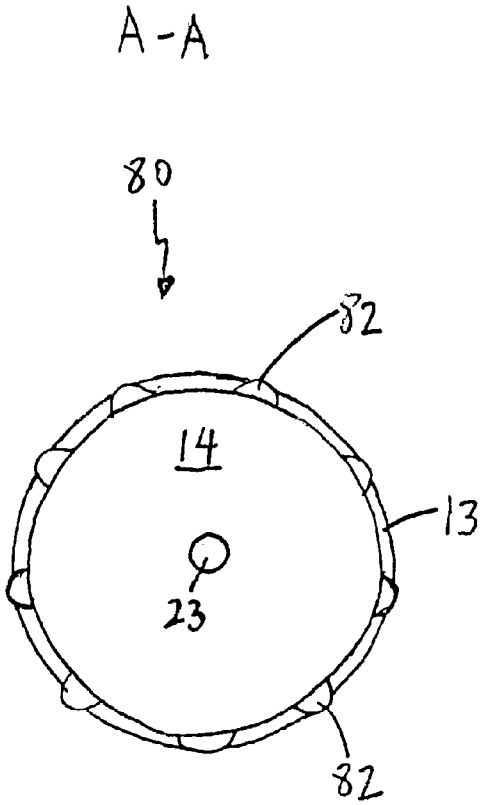
FIG. 12 illustrates a cross-sectional view of the device port of FIG. 11, taken along a perspective indicated by lines A—A of FIG. 11, in accordance with one embodiment of the invention.

FIG. 12 illustrates a cross-sectional view of the device port 80 of FIG. 11, taken from a perspective along lines A—A of FIG. 11. The slide contacts 81 are embedded in the side wall 13 which forms the interior chamber 14 in a circular fashion surrounding the interior chamber 14. In a preferred embodiment, the surfaces of the slide contacts 18 that are exposed within the chamber 14 are substantially flush with the interior surface of the side wall 13 so as to allow easy movement of the cylindrical prong 86 into and out of the chamber 14.

Figure 13:
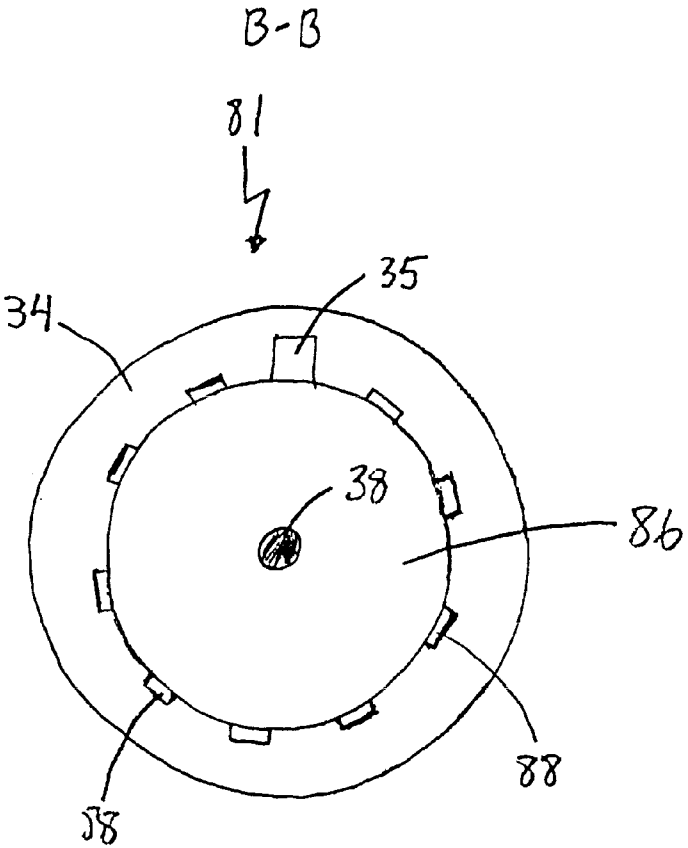
FIG. 13 illustrates a bottom view of the connector of FIG. 11, taken along a perspective indicated by lines B—B of FIG. 11, in accordance with one embodiment of the invention.

FIG. 13 illustrates a bottom view of the connector 81 of FIG. 11, taken from a perspective along lines B—B of that figure. As shown in FIG. 13, the slide contacts 88 are distributed in a circular fashion around the cylindrical side wall of the prong 86. When the prong 86 is fully inserted into the interior chamber 14, each slide contact 88 makes electrical contact with a corresponding one of the plurality of slide contacts 82 so as to provide an electrical conduction path for a desired electrical signal to a peripheral device. Elements such as the ground slide contacts 29, the ground groove contacts 30, the flanged end 34, the guide notch 35 and the guide groove 36, are described and referenced with like numerals above with respect to the previous figures and, therefore, the description of these elements need not be repeated here.

Thus, the invention provides a device port and associated connector which may be easily implemented by automobile manufacturers, with minimal redesign and retooling, by utilizing existing cigarette lighter and power port configurations to create the device ports of the invention. Additionally, the simplicity of the port to connector interface enables aftermarket vendors and device manufacturers to easily design peripheral device specifications and features that would be compatible with the interface/connection specifications provided by the invention.

Various preferred embodiments of the invention have been described above. However, it is understood that these various embodiments are exemplary only and should not limit the scope of the invention as recited in the claims below. It is also readily understood by those of ordinary skill in the art how to design and implement the pins, sockets, contacts and other features of the invention described above such that they provide the desired number and type of electrical signals to a particular peripheral device. For example, it may not be necessary for particular connectors to achieve an electrical contact with every pin, socket or contact within a particular device port. For example, for certain applications or peripheral devices only a select subset of available signals may be desired or required. Additionally, it is readily apparent to those of ordinary skill in the art that the locations and positions of the pins, sockets and/or contacts may be rearranged to conform to any desired configuration. In sum, various modifications of the preferred embodiments described above can be implemented by those of ordinary skill in the art, without undue experimentation. These various modifications are contemplated to be within the spirit and scope of the invention as set forth in the claims below. As used herein and below, the terms "electrical contact elements" or "contact elements," and conjugations thereof, collectively refer to the pins, sockets and contacts described above, and similar electrical contact structures.

What is claimed is:

1. A peripheral device port configured to be integrated with a power port in a motor vehicle comprising:

a first chamber configured to receive therein a prong of a peripheral device connector;

a power contact element located within said first chamber for providing power to said connector, wherein said power contact element is connected to a power source within said motor vehicle;

at least one ground contact element located within said first chamber for providing an electrical conduction path to electrical ground for said connector;

at least one first contact element configured to make electrical contact with at least one second contact element located on said connector when said prong is inserted into said first chamber, a second chamber adjacent to said first chamber, wherein said at least one first contact element is located within said second chamber;

an insulating cover disposed between said first and second chambers and spring loaded so as to be biased toward said first chamber;

wherein, when said prong is inserted into said first chamber, said prong passes through said first chamber and enters said second chamber, pushing said insulating cover away from said first chamber and further into said second chamber; and wherein said at least one second contact element is located on a first end of said prong so as to make electrical contact with said at least one first contact element, when said first end of said prong is positioned within said second chamber.

2. The peripheral device port of claim 1 wherein said at least one first contact element comprises at least one first slide contact and said at least one second contact element comprises at least one second slide contact such that said at least one first slide contact makes electrical contact with said at least one second slide contact when said first end of said prong is positioned within said second chamber.

3. The peripheral device port of claim 1 wherein said at least one first contact element comprises at least one first slide contact located on a side wall of said first chamber and said at least one second contact element comprises at least one second slide contact located on a side wall of said prong, wherein said at least one first slide contact is positioned and configured to make electrical contact with said at least one second slide contact when said prong is inserted into said first chamber.

4. The peripheral device port of claim 1 wherein said insulating cover further comprises:

a center hole for allowing said power contact element to pass therethrough; and at least one contact hole for allowing said at least one first contact element to make electrical contact with said at least one second contact element when said first end of said prong is positioned within said second chamber.

5. The peripheral device port of claim 4 wherein said at least one first contact element comprises at least one contact pin, said at least one second contact element comprises at least one pin socket, and said at least one contact hole comprises at least one pin hole such that said at least one contact pin protrudes through said at least one pin hole, making electrical contact with said at least one pin socket, when said first end of said prong is positioned within said second chamber.

6. The peripheral device port of claim 1 wherein said at least one first contact element is located adjacent an opening of said first chamber, said prong of said connector includes a flanged end, and said at least one second contact element is located on an underside of a lip of said flanged end, wherein, when said prong is inserted into said first chamber, said at least one first contact element makes electrical contact with said at least one second contact element.

7. The peripheral device port of claim 6 wherein said at least one first contact element comprises at least one pin socket and said at least one second contact element comprises at least one contact pin, wherein said at least one pin socket is positioned and configured to receive and make electrical contact with said at least one contact pin when said prong is inserted into said first chamber.

8. A peripheral device port and connector system for use in a motor vehicle comprising:

a port comprising a first chamber at least one first ground contact element located within said first chamber and connected to an electrical ground within said motor vehicle a first power contact element positioned within said first chamber and connected to a power source within said motor vehicle, and at least one first contact element, wherein said port is configured to be integrated with a power port of said motor vehicle;

a connector comprising a prong configured to be received within said first chamber, at least one second ground contact element, a second power contact element, and at least one second contact element, wherein, when said prong is inserted into said first chamber, said at least one second ground contact element makes electrical contact with said at least one first ground contact element, said second power contact element makes electrical contact with said first power contact element, and said at least one contact element makes electrical contact with said at least one first contact element;

a second chamber adjacent to said first chamber, wherein said at least one first contact element is located within said second chamber;

an insulating cover disposed between said first and second chambers and spring loaded so as to be biased toward said first chamber;

wherein, when said prong is inserted into said first chamber, said prong passes through said first chamber and enters said second chamber, pushing said insulating cover away from said first chamber and further into said second chamber; and wherein said at least one second contact element is located on a first end of said prong so as to make electrical contact with said at least one first contact element, when said first end of said prong is positioned within said second chamber.

9. The system of claim 8 wherein said at least one first contact element comprises at least one first slide contact and said at least one second contact element comprises at least one second slide contact such that said at least one first slide contact makes electrical contact with said at least one second slide contact when said first end of said prong is positioned within said second chamber.

10. The system of claim 8 wherein said at least one first contact element comprises at least one first slide contact located on a side wall of said first chamber and said at least one second contact element comprises at least one second slide contact located on a side wall of said prong, wherein said at least one first slide contact is positioned and configured to make electrical contact with said at least one second slide contact when said prong is inserted into said first chamber.

11. The system of claim 8 wherein said insulating cover comprises:

a center hole for allowing said first power contact element to past therethrough; and at least one contact hole for allowing said at least one first contact element to make electrical contact with said at least one second contact element when said first end of said prong is positioned within said second chamber.

12. The system of claim 11 wherein said at least one first contact element comprises at least one contact pin, said at least one second contact element comprises at least one pin socket, and said at least one contact hole comprises at least one pin hole such that said at least one contact pin protrudes through said at least one pin hole, making electrical contact with said at least one pin socket, when said first end of said prong is positioned within said second chamber.

13. The system of claim 8 wherein said at least one first contact element is located adjacent an opening of said first chamber, said prong of said connector includes a flanged end, and said at least one second contact element is located on an underside of a lip of said flanged end, wherein, when said prong is inserted into said first chamber, said at least one first contact element makes electrical contact with said at least one second contact element.

14. The system of claim 13 wherein said at least one first contact element comprises at least one pin socket and said at least one second contact element comprises at least one contact pin, wherein said at least one pin socket is positioned and configured to receive and make electrical contact with said at least one contact pin when said prong is inserted into said first chamber.

* * * * *